US005411825A

United States Patent [19]

Tam

[11] Patent Number: 5,411,825

[45] Date of Patent: May 2, 1995

[54] HEAT DEVELOPMENT PROCESS OF MIGRATION IMAGING MEMBERS

[75] Inventor: Man C. Tam, Mississauga, Canada

[73] Assignee: Xerox Corporation, Stamford, Conn.

[21] Appl. No.: 598,279

[22] Filed: Oct. 16, 1990

[51] Int. Cl.[6] ..... G06G 13/70; G06G 13/78

[52] U.S. Cl. ..... 430/41; 430/124; 430/350; 430/4; 250/317.1; 250/319; 219/216; 219/388; 355/285; 347/114; 347/140; 347/156

[58] Field of Search ..... 250/319, 317.1; 430/41, 430/49, 124, 350; 355/285, 286, 288, 282; 346/151, 153.1; 219/216, 388

[56] References Cited

U.S. PATENT DOCUMENTS

| | | | |
|---|---|---|---|
| 3,390,634 | 7/1968 | Verderber | 101/463 |
| 3,825,724 | 7/1974 | Kingsley et al. | 219/469 |
| 3,909,262 | 9/1975 | Goffe et al. | 96/1.5 |
| 3,975,195 | 8/1976 | Goffe | 96/1 PS |
| 3,980,863 | 9/1976 | Wulz et al. | 219/388 |
| 3,997,790 | 12/1976 | Suzuki et al. | 250/319 |
| 4,013,462 | 3/1977 | Goffe et al. | 96/1 PS |
| 4,077,803 | 3/1978 | Gravel | 96/1.1 |
| 4,140,894 | 2/1979 | Kawakura et al. | 219/358 |
| 4,161,644 | 7/1979 | Yanagawa et al. | 219/216 |
| 4,435,072 | 3/1984 | Adachi et al. | 355/3 FU |
| 4,536,457 | 8/1985 | Tam | 430/41 |
| 4,536,458 | 8/1985 | Ng | 430/41 |
| 4,751,528 | 6/1988 | Spehrley, Jr. et al. | 346/104 R |
| 4,883,731 | 11/1989 | Tam et al. | 430/41 |

OTHER PUBLICATIONS

Migration Imaging: Mechanisms, Exploitation, and Future Prospects of Unique Photographic Technologies, XDM and AMEN, Vincett, P. S. et al., "Migration Imaging", vol. 30, No. 4, Jul./Aug. 1986 pp. 183 to 191.

*Primary Examiner*—Christopher D. Rodee
*Attorney, Agent, or Firm*—Judith L. Byorick

[57] ABSTRACT

Disclosed is an apparatus for heat development of a migration imaging member containing migration marking material and a softenable material capable of softening upon exposure to heat at a development temperature, which apparatus comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development.

10 Claims, 1 Drawing Sheet

HEAT DEVELOPMENT PROCESS OF MIGRATION IMAGING MEMBERS

BACKGROUND OF THE INVENTION

The present invention is directed to an apparatus and process for developing images. More specifically, the present invention is directed to an apparatus and process for heat development of migration imaging members. One embodiment of the present invention is directed to an apparatus for heat development of a migration imaging member containing migration marking material and a softenable material capable of softening upon exposure to heat at a development temperature, which apparatus comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development.

Migration imaging members are well known, and are described in detail in, for example, U.S. Pat. No. 3,975,195 (Goffe), U.S. Pat. No. 3,909,262 (Goffe et al.), U.S. Pat. No. 4,536,457 (Tam), U.S. Pat. No. 4,536,458 (Ng), U.S. Pat. No. 4,013,462 (Goffe et al.), and "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosures of each of which are totally incorporated herein by reference. Migration imaging members containing charge transport materials in the softenable layer are also known, and are disclosed, for example, in U.S. Pat. No. 4,536,457 (Tam) and U.S. Pat. No. 4,536,458 (Ng), the disclosures of each of which are totally incorporated herein by reference. A typical migration imaging member comprises a substrate, a layer of softenable material, and photosensitive marking material in the form of a fracturable layer contiguous with the upper surface of the softenable layer. The member is imaged by first electrically charging the member and exposing the charged member to a pattern of activating electromagnetic radiation, such as light, to form a latent image on the member. Subsequently, the imaged member is developed by one of several methods, such as application of heat, solvent, solvent vapor, or the like, causing the marking material in the exposed areas of the member to migrate in depth through the softenable material toward the substrate.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate used in this invention.

There are various other systems for forming such images, wherein non-photosensitive or inert marking materials are arranged in the aforementioned fracturable layers, or dispersed throughout the softenable layer, as described in the aforementioned patents, which also discloses a variety of methods which can be used to form latent images upon migration imaging members.

The background portions of an imaged member can sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 (Ng) and U.S. Pat. No. 4,536,457 (Tam).

Methods of developing or fixing images by heat are known. For example, U.S. Pat. No. 4,435,072 (Adachi et al.) discloses an image formation apparatus having a fixing station for applying high frequency waves to fix an image on a recording medium. In operation, a latent image is formed on a photosensitive drum, and the latent image is developed with a developer. The developed image is then transferred to a recording medium and exposed to high frequency waves to affix the transferred image to the recording medium. In one embodiment, the fixing apparatus comprises one or more pairs of rollers of a high-frequency wave absorbing material. High frequency waves are applied to the image in a manner so as to reduce escape of high frequency waves from leaking; the absorbing rollers help reduce leakage and also become heated by absorption of high frequency waves, which assists in fixing the image to the recording medium.

U.S. Pat. No. 3,997,790 (Suzuki et al.) discloses an apparatus for heat-fixing a toner image onto a support sheet wherein fixing is effected through both infrared radiation and direct contact with a heated surface of fixing roller in succession. An endless belt transparent to infrared light and trained over a pair of rollers is disposed within a heat insulating casing, an upper run of the belt defining a path of movement of a toner image-bearing support sheet to be fixed. An infrared radiator is disposed beneath the upper run of belt while a reflecting plate is disposed at the opposite of the belt. A fixing roller is disposed downstream of the radiator along the path for completing the fixing.

U.S. Pat. No. 4,077,803 (Gravel) discloses a method and apparatus for uniformly charging a single layer thermoplastic recording surface either positively or negatively to a potential just below the first threshold level for exposing the thermoplastic surface to light in image configuration, and for applying a heat pulse to the thermoplastic surface for a time relatively short compared to the duration of the light exposure interval and during the exposure. The charging event is arranged so that the thermoplastic surface is raised only to a relatively low potential with respect to ground.

U.S. Pat. No. 4,161,644 (Yanagawa et al.) discloses an electric heater means for thermally fixing a toner image to a copy sheet to produce a permanent electrostatic copy of an original document. The heater means is normally energized at partial power but is switched to full power by means of microswitches at the inlet and outlet of the heater means which are actuated by the copy sheet while the copy sheet passes through the heater means. The heater means is switched to full power for a shorter length of time during a multiple copy operation than during a single copy operation.

U.S. Pat. No. 4,751,528 (Spehrley, Jr. et al.) discloses a hot melt ink jet system including a temperature controlled platen provided with a heater and a thermoelectric cooler electrically connected to a heat pump and a temperature control unit for controlling the operation of the heater and the heat pump to maintain the platen temperature at a desired level. The apparatus also includes a second thermoelectric cooler to solidify hot melt ink in a selected zone more rapidly to avoid offset by a pinch roll coming in contact with the surface of the substrate to which hot melt ink has been applied. An airtight enclosure surrounding the platen is connected to a vacuum pump and has slits adjacent to the platen to hold the substrate in thermal contact with the platen.

Although known apparatuses and processes are suitable for their intended purposes, a need remains for apparatuses suitable for heat development of migration imaging members. In addition, a need remains for heat developer apparatuses that can develop migration imaging members without damaging them in such a manner as to impair image quality. Further, there is a need for heat developer apparatuses that do not cause dimensional distortion to migration imaging members during development, which could result in difficulties such as color misregistration when the migration imaging members are used to prepare color separation xeroprinting masters for color xeroprinting. A need also exists for heat development apparatuses that do not contact migration imaging members in such a manner as to impair image quality. In addition, there is a need for heat development apparatuses that enable automatic feeding of migration imaging members into the apparatus and enable practical implementation in a machine environment. Further, there is a need for heat development apparatuses that enable automatic feeding of migration imaging members and enable uniform heat development. There is also a need for heat development apparatuses with a simple and compact design and which can easily accommodate imaging members of different sizes.

SUMMARY OF THE INVENTION

It is an object of the present invention to provide apparatuses suitable for heat development of migration imaging members.

It is another object of the present invention to provide heat developer apparatuses that can develop migration imaging members without damaging them in such a manner as to impair image quality.

It is yet another object of the present invention to provide heat developer apparatuses that do not cause dimensional distortion to migration imaging members during development so that problems such as color mis-registration are avoided when the migration imaging members are used to prepare color separation xeroprinting masters for color xeroprinting.

It is still another object of the present invention to provide heat development apparatuses that do not contact a migration imaging member in such a manner as to impair image quality.

Another object of the present invention is to provide heat development apparatuses that enable automatic feeding of migration imaging members into the apparatus and enable practical implementation in a machine environment.

Yet another object of the present invention is to provide heat development apparatuses that enable automatic feeding of migration imaging members and uniform heat development.

Still another object of the present invention is to provide heat development apparatuses with a simple and compact design and which can easily accommodate imaging members of different sizes.

These and other objects of the present invention can be achieved by providing an apparatus for heat development of a migration imaging member containing migration marking material and a softenable material capable of softening upon exposure to heat at a development temperature, which apparatus comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development.

In one specific embodiment of the invention, a heat shield is situated on at least one side of the imaging member where it is exposed to the heat source so as to inhibit the escape of heat from the heating source during exposure of the imaging member to heat, and the first and second pinch rollers are situated outside of the heat shield, thereby maintaining them at a surface temperature at least 20° C. below the development temperature of the migration imaging member during development. In another specific embodiment of the present invention, the pinch rollers are maintained at a surface temperature at least 20° C. below the development temperature of the migration imaging member during development by a cooling means which removes heat from the roller surfaces.

DETAILED DESCRIPTION OF THE PREFERRED EMBODIMENTS

Figure 1:
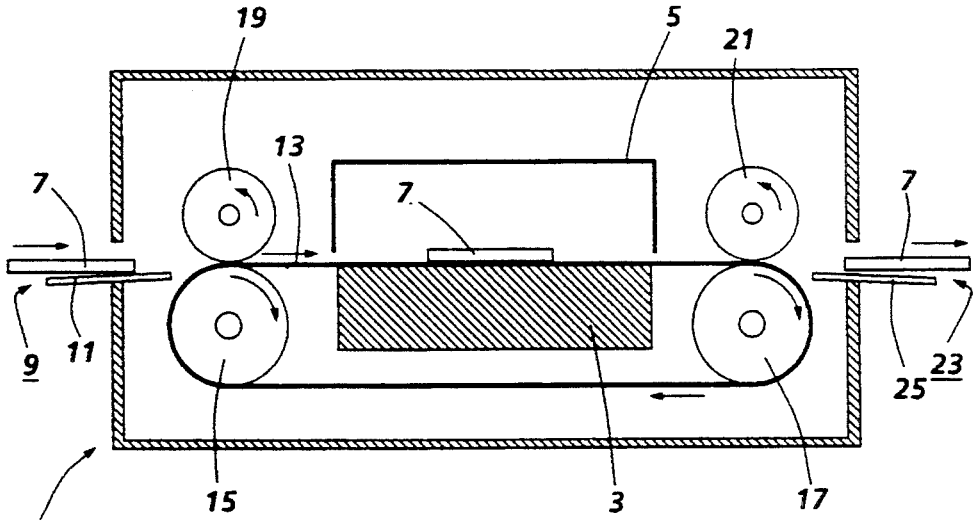
FIG. 1 illustrates schematically an embodiment of the heat developer apparatus of the present invention.

Illustrated schematically in FIG. 1 is an embodiment of the heat developer of the present invention. As shown, heat development apparatus 1 contains heating source 3. Heating source 3 can be any suitable heat source, such as a resistive heater, a radiative heater, or any other heating means. Heating source 3 is of a nature that enables uniform heating over the entire surface of a migration imaging member. Thus, when, as shown in the figure, the migration imaging member is in sheet form, heating source 3 is of dimensions that enable uniform heating of at least one sheet of imaging member. When the imaging member is in a configuration such as a strip or roll, heating source 3 is of dimensions that enable uniform heating over the entire surface of at least one imaged area of a migration imaging member. The heating source preferably delivers heat uniformly to all portions of the imaging member. This end can be achieved by any suitable means. For example, a block of a metal such as aluminum and of dimensions equal to or greater than the dimensions of the imaging member can contain a heating element such as a resistive heater; heat conduction through the metal block generally is uniform and delivers heat evenly to all portions of the imaging member. Heat emitted from heating source 3 preferably is localized within the development zone. This heat localization can be achieved, for example, by surrounding the heating source 3 with heat-insulative materials in all areas except for the portion of the heating source 3 facing the development zone. Examples of suitable heat-insulative materials include polyurethane, polystyrene, fibre glass, polyester, epoxy, polyimide, polycarbonate, fluoropolymers such as Teflon, polysulfone, and the like. The heat-insulative material should be capable of withstanding the development temperatures of migration imaging members without incurring damage, and preferably can withstand temperatures of at least about 130° C.

Situated over heating source 3 is heat shield 5. Heat shield 5 retains heat emitted from heat source 3 in the area where development of imaging members is effected within apparatus 1, thereby reducing the amount of heat that escapes the development zone, and enabling more uniform and efficient heating. Heat shield 5 also localizes heat emitted from heat source 3 within the development zone, thereby reducing heating of other portions of apparatus 1. Heat shield 5 can be of any suitable configuration, such as a rectangular covering, a dome covering, or any other suitable configuration, and is of any suitable dimensions to enable the heat shield 5 to encompass the entire heat development zone. The heat shield preferably is made of a heat-insulative material; examples of heat-insulative materials include polyurethane foam, polystyrene foam, fibre glass, polyester, epoxy, polyimide, polycarbonate, fluoropolymers such as Teflon, polysulfone, or the like. The heat shield should be capable of withstanding the heat development temperatures of migration imaging members, and preferably can withstand temperatures of at least about 130° C. without incurring damage. Alternatively, heat shield 5 can comprise a sheet metal, such as aluminum, having a heat-insulative material laminated to the surface of the sheet metal facing away from heating source 3. To help confine and uniformly distribute heat emitted from heat source 3, the surface of heat shield 5 facing heating source 3 preferably has a heat reflective surface, which can be provided, for example, by a polished metallic surface such as a polished aluminum surface or by aluminum foil. Imaging member 7 is fed into apparatus 1 through entry 9, optionally equipped with feed guide 11. Imaging member 7 is conveyed past heating source 3 by conveyance 13 moving in the direction of the arrow. As shown in FIG. 1, conveyance 13 is an endless belt situated around conveyance rollers 15 and 17. As will be appreciated by those skilled in the art, conveyance 13 can have other configurations, such as a roll, a sheet, or the like. Imaging member 7 is fed into apparatus 1 with the substrate surface of the imaging member 7 contacting conveyance 13. Conveyance 13 is driven by a motor (not shown). When conveyance 13 is an endless belt situated around 2 or more conveyance rollers, at least one of conveyance rollers 15 and 17 is driven by the motor; when only one conveyance roller is driven, the other functions as an idler roller. When conveyance 13 is of another configuration, such as a roll, a sheet, or the like, a portion of the conveyance is situated within the heat shield 5 and a portion extends beyond the heating zone within heat shield 5 so that pinch rollers 19 and 21 can contact conveyance 13 outside of the heating zone.

Pinch rollers 19 and 21 contact conveyance 13 so that a nip is formed between pinch rollers 19 and 21 and conveyance 13. The pinch rollers 19 and 21 need not be driven by a motor, since they will move as a result of being in contact with moving conveyance 13. The leading edge of imaging member 7 contacts the nip between conveyance 13 and pinch roller 19 as imaging member 7 is fed into the apparatus, which draws the imaging member 7 into apparatus 1 so that imaging member 7 rests on conveyance 13. Imaging member 7 then passes through the development zone encompassed by heating source 3 and heat shield 5, and subsequently passes through the nip between pinch roller 21 and conveyance 13 and exits apparatus 1 through exit 23 optionally equipped with exit guide 25. In addition to providing a means for transporting the imaging member within the apparatus, pinch rollers 19 and 21 provide a means for maintaining imaging member 7 in uniform intimate contact with conveyance 13. The imaging member 7 can pass through heat development apparatus 1 continuously, at a uniform speed. Alternatively, imaging member 7 can be positioned in apparatus 1 and held in place within the heating zone inside heat shield 5 until development is completed and then removed.

As shown in FIG. 1, heat shield 5 is situated over imaging member 7 on the side of conveyance 13 opposite to that where heating source 3 is situated. As will be appreciated by those skilled in the art, other configurations are possible. For example, instead of being situated under conveyance 13 as shown in FIG. 1, heating source 3 can be situated so that it directs heat onto imaging member 7 from above. Further, heat shield 5 can also encompass heating source 3; when heating source 3 is situated as shown in FIG. 1, the heat shield in this instance possesses entry and exit slots to permit the imaging member 7 to enter and exit the heating zone.

In the embodiment of the present invention illustrated in FIG. 1, it is important that pinch rollers 19 and 21 are situated outside of heat shield 5 so that the surface of imaging member 7 is not damaged by being contacted with pinch rollers 19 and 21 heated to development temperatures. While the imaging member is not damaged by the heat development process, contacting the surface of the imaging member with articles heated to development temperatures can result in defects in the developed imaging member caused by offset (sticking or adhesion) of the surface of imaging member onto the pinch rollers. These defects generally manifest as spotty film pick-offs (pin holes in the imaging member), streaks, depressions, or large area delamination of softenable layer from the substrate. To reduce the possibility of damage to imaging member 7, pinch rollers 19 and 21 are maintained at a temperature at least about 20° C. below the development temperature of migration imaging member 7, and preferably at least about 25° C. below the development temperature of migration imaging member 7 during development.

In the embodiment of the present invention illustrated in FIG. 1, pinch rollers 19 and 21 preferably have surfaces of an adhesive, nonsticking material to prevent damage to imaging member 7. The terms adhesive and nonsticking as used to describe the surfaces of the rollers refer to adhesive and nonsticking characteristics with respect to the material on the imaging member surface with which the rollers come into as fluoropolymers including poly(tetrafluoroethylene), Teflon®, contact during development. Examples of suitable materials for the pinch roller surface include silicone polymers, low surface energy polymers such as fluoropolymers including poly(tetrafluoroethylene), Teflon®, poly(heptafluoropropylethylene), poly(heptafluoropropylethylene-cotetrafluoroethylene), poly(trifluoromethyltrifluoroethylene), and the like, as well as any other material with a low surface energy. Other examples of suitable pinch roller materials include those commonly used for low surface energy electrophotographic fuser rolls to prevent offset of fused toner images onto the fuser roll, such as poly(trifluoromethyltrifluoroethylene-co-tetrafluoroethylene) and the Viton®polymers. Further examples of suitable adhesive, nonsticking materials are disclosed in, for example, U.S. Pat. No. 4,264,181 and U.S. Pat. 4,777,087, the disclosures of each of which are totally incorporated herein by reference.

Figure 2:
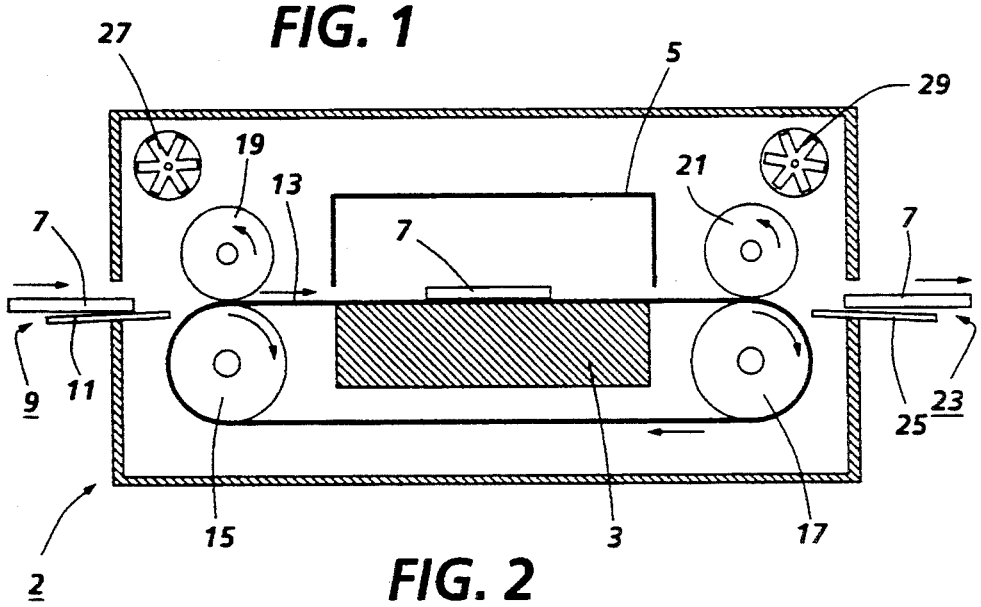
FIG. 2 illustrates schematically another embodiment of the heat developer apparatus of the present invention.

Another embodiment of the present invention is illustrated schematically in FIG. 2. As shown in FIG. 2, the apparatus 2 comprises a heating source 3, entry 9 optionally equipped with feed guide 11, conveyance 13 moving in the direction of the arrow, conveyance rollers 15 and 17 (when conveyance 13 is in the form of an endless belt), pinch rollers 19 and 21, and exit 23 optionally equipped with exit guide 25. Pinch rollers 19 and 21 are maintained at a temperature at least about 20° C. below the development temperature of the imaging member 7 by removing heat from the roller surfaces with coolers 27 and 29. Coolers 27 and 29 can each be any suitable means for cooling the surfaces of pinch rollers 19 and 21, such as fans, circulating bath, refrigeration units, or the like. By cooling pinch rollers 19 and 21 to a temperature at least about 20° C. below the development temperature of the imaging member 7, damage to the member is avoided when pinch rollers 19 and 21 contact member 7. A heat shield 5 can optionally be present, but is not required. Specifically, when the coolers are of a type that recirculate air around the pinch rollers, a heat shield 5 is preferably present so that the rollers are separated from the heating source and the development zone. When the coolers are of a type that cool the pinch rollers by recirculating coolant fluid or by refrigeration, no heat shield is necessary.

The present invention is also directed to an imaging process which comprises (1) providing a migration imaging member comprising (a) a substrate and (b) a softenable layer comprising a softenable material, optional charge transport material, and migration marking material situated contiguous to the surface of the softenable layer spaced from the substrate; (2) uniformly charging the imaging member; (3) exposing the charged imaging member to activating radiation in an imagewise pattern, thereby forming an electrostatic latent image on the imaging member; and (4) developing the imaging member with a heat development apparatus which comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development, thereby causing migration marking material to migrate through the softenable material toward the substrate in imagewise fashion.

Further, the present invention encompasses a xeroprinting process which comprises (1) providing a migration imaging member comprising (a) a substrate and (b) a softenable layer comprising a softenable material, a charge transport material, and migration marking material situated contiguous to the surface of the softenable layer spaced from the substrate; (2) uniformly charging the imaging member; (3) exposing the charged imaging member to activating radiation in an imagewise pattern, thereby forming an electrostatic latent image on the imaging member; (4) developing the imaging member with a heat development apparatus which comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development, thereby causing migration marking material to migrate through the softenable material toward the substrate in imagewise fashion to result in a xeroprinting master; (5) uniformly charging the xeroprinting master; (6) uniformly exposing the charged master to activating radiation to result in an electrostatic latent image corresponding to the migration image; (7) developing the electrostatic latent image with a toner; and (8) transferring the developed image to a receiver sheet.

Figure 3:
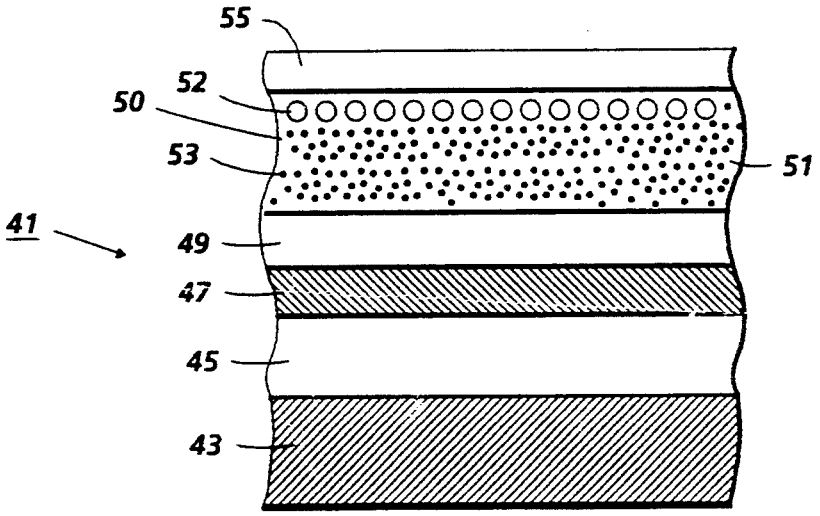
FIG. 3 illustrates schematically a migration imaging member suitable for use in the apparatus and process of the present invention.

An example of a migration imaging member suitable for the process of the present invention is illustrated schematically in FIG. 3. As shown in FIG. 3, migration imaging member 41 comprises a substrate 43, an optional adhesive layer 45 situated on the substrate, an optional charge blocking layer 47 situated on optional adhesive layer 45, an optional charge transport layer 49 situated on optional charge blocking layer 47, and a softenable layer 50 situated on optional charge transport layer 49, said softenable layer 50 comprising softenable material 51, migration marking material 52 situated at or near the surface of the layer spaced from the substrate, and, optionally, charge transport material 53 dispersed throughout softenable material 51. Optional overcoating layer 55 is situated on the surface of softenable layer 50 spaced from the substrate 43. Any or all of the optional layers or materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442, (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has an effective thickness, generally from about 6 to about 250 microns, and preferably from about 50 to about 200 microns.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrenevinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, generally from about 1 to about 30 microns, and preferably from about 2 to about 25 microns. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the substrate. When present as particles, the particles of migration marking material preferably have an average diameter of up to about 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to about 0.1 micron from the layer surface, and more preferably from about 0.02 to about 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in an effective amount, preferably from about 5 percent to about 25 percent by total weight of the softenable layer, and more preferably from about 10 to about 20 percent by total weight of the softenable layer.

Examples of suitable migration marking materials include selenium, alloys of selenium with alloying components such as tellurium, arsenic, mixtures thereof, and the like, phthalocyanines, and any other suitable materials as disclosed, for example, in U.S. Pat. No. 3,975,195 and other U.S. patents directed to migration imaging members and incorporated herein by reference.

The migration marking particles can be included in the imaging member by any suitable technique. For example, a layer of migration marking particles can be placed at or just below the surface of the softenable layer by solution coating the first conductive layer with the softenable layer material, followed by heating the softenable material in a vacuum chamber to soften it, while at the same time thermally evaporating the migration marking material onto the softenable material in a vacuum chamber. Other techniques for preparing monolayers include cascade and electrophoretic deposition. An example of a suitable process for depositing migration marking material in the softenable layer is disclosed in U.S. Pat. No. 4,482,622, the disclosure of which is totally incorporated herein by reference.

The migration imaging member optionally contains a charge transport material in the softenable layer. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyloN,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-[lepidyl-(2)]-3-(p-diethylaminophenyl)-5-(p-diethylaminophenyl)-pyrazoline, 1-[quinolyl-(2)]-3-(p-diethylaminophenyl)-5-(p-diethylaminophenyl)pyrazoline, 1-[pyridyl(2)]-3-(p-diethylaminostyryl)-5-(p-diethylaminophenyl)-pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(pdimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene; 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example, in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S.

Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

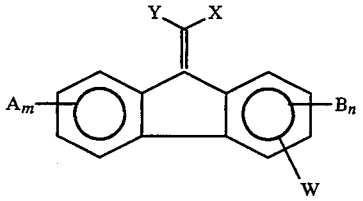

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)-malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1,3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

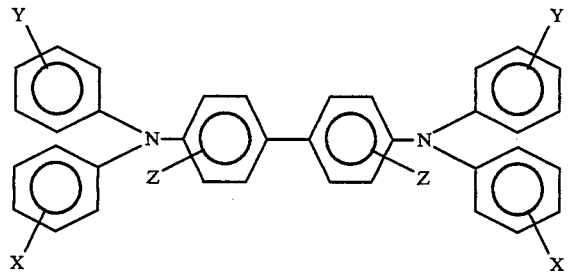

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Excellent results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3''-methylphenyl)-(1,1'-biphenyl) -4,4'-diamine based on the total weight of the softenable layer.

When present, the charge transport material is present in the softenable material in an effective amount, generally from about 5 to about 50 percent by weight and preferably from about 8 to about 40 percent by weight. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wirewound rod coating, air knife coating, and the like.

The optional abhesive layer can include any suitable abhesive material. Typical abhesive materials include copolymers of styrene and an acrylate, polyester resin such as DuPont 49000 (available from E.I. dupont de Nemours & Company), copolymer of acrylonitrile and vinylidene chloride, polyvinyl acetate, polyvinyl butyral and the like and mixtures thereof. The abhesive layer can have a thickness of from about 0.05 to about 1 micron. When an abhesive layer is employed, it preferably forms a uniform and continuous layer having a thickness of about 0.5 micron or less. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 deciliters per gram; other copolymers of styrene and hexylmethacrylate, styrene-vinyltoluene copolymers, polyalphamethylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the xeroprinting master making and xeroprinting steps of the present invention. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of an effective thickness, generally from about 1 to about 25 microns, and preferably from about 2 to about 20 microns.

Charge transport molecules suitable for the charge transport layer are described in detail herein. The specific charge transport molecule utilized in the charge transport layer of any given imaging member can be identical to or different from a charge transport molecule employed in an adjacent softenable layer. Similarly, the concentration of the charge transport molecule utilized in the charge transport spacing layer of any given imaging member can be identical to or different from the concentration of charge transport molecule employed in an adjacent softenable layer. When the charge transport material and film forming binder are combined to form a charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside of this range. The charge transport material can be incorporated into the charge transport layer by similar techniques to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of an effective thickness, generally from about 0.05 to about 0.5 micron, and preferably from about 0.05 to about 0.1 micron. Typical coating processes include draw bar coating, spray coating, extrusion, dip coating, gravure roll coating, wirewound rod coating, air knife coating and the like.

The optional overcoating layer can be substantially electrically insulating, or have any other suitable properties. The overcoating preferably is substantially transparent, at least in the spectral region where electromagnetic radiation is used for imagewise exposure step in the master making process and for the uniform exposure step in the xeroprinting process. The overcoating layer is continuous and preferably of a thickness up to about 1 to about 2 microns. More preferably, the overcoating has a thickness of from about 0.1 to about 0.5 micron to minimize residual charge buildup. Overcoating layers greater than about 1 to about 2 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling, and, if the imaged member is to be used in xeroprinting processes, during master making and xeroprinting. The overcoating layer preferably adheres strongly to the softenable layer to minimize damage. The overcoating layer can also have abhesive properties at its outer surface which provide improved resistance to toner filming during toning, transfer, and/or cleaning. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 20 ergs per square centimeter. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, after the members have been imaged, and during xeroprinting.

The migration imaging member can be imaged by connecting the conductive substrate layer to a reference potential such as a ground, uniformly charging in the dark the surface of the member spaced from the conductive layer to either a negative polarity or to a positive polarity, and subsequently exposing the charged surface of the imaging member to activating radiation, such as light, in an imagewise pattern, thereby forming an electrostatic latent image on the member surface. Subsequently, the migration imaging member is developed by passing it through the heat development apparatus of the present invention, thereby causing the softenable material to soften and enabling the migration marking particles to migrate through the softenable material toward the conductive layer. The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material decreases in viscosity, thereby decreasing its resistance to migration of the marking material through the softenable layer. In the exposed areas of the imaging member, the migration marking material gains a substantial net charge which, upon softening of the softenable material, causes the exposed marking material to migrate in image configuration towards the substrate and disperse in the softenable layer, resulting in a Drain area. The unexposed migration marking particles in the unexposed areas of the imaging member remain essentially neutral and uncharged. Thus, in the absence of migration force, the unexposed migration marking particles remain substantially in their original position in the softenable layer, resulting in a Dmax area. Thus, the developed image is an optically sign-retaining visible image of an original (if a conventional light-lens exposure system is utilized). Exposure can also be by means other than light-lens systems, including raster output scanning devices such as laser writers. The application of heat should be sufficient to decrease the resistance of the softenable material of the softenable layer to allow migration of the migration marking material through the softenable layer in imagewise configuration. With heat development, satisfactory results can be achieved by heating the imaging member to a temperature of about 100° C. to about 130° C. for only a few seconds when the unovercoated softenable layer contains a custom synthesized 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine. The test for a satisfactory combination of time and temperature is to maximize optical contrast density and electrostatic contrast potential for xeroprinting. The developed imaging member is transmitting to visible light in the exposed region because of the depthwise migration and dispersion of the migration marking material in the exposed region. The $D_{min}$ obtained in the exposed region generally is slightly higher than the optical density of transparent substrates underlying the softenable layer. The $D_{max}$ in the unexposed region generally is essentially the same as the original unprocessed imaging member because the positions of migration marking particles in the unexposed regions remain essentially unchanged.

When the softenable layer contains a charge transport material, the developed imaging member can then, if desired, be employed as a xeroprinting master in a xeroprinting process. This process entails uniformly charging the developed imaging member (now a xeroprinting master) by a charging means such as a corona charging device. Generally, charging the developed imaging member to either a positive or negative voltage of from about 50 to about 1200 volts is suitable for the process of the present invention, although other values can be employed. The charged xeroprinting master is then uniformly flash exposed to activating radiation such as light energy to form an electrostatic latent image. The activating electromagnetic radiation used for the uniform exposure step should be in the spectral region where the migration marking particles photogenerate charge carriers. Light in the spectral region of 300 to 800 nanometers is generally suitable for the process of the present invention, although the wavelength of the light employed for exposure can be outside of this range, and is selected according to the spectral response of the specific migration marking particles selected. The exposure energy should be such that the desired and/or optimal electrostatic contrast potential is obtained, and preferably is from about 10 ergs per square centimeter to about 100,000 ergs per square centimeter. Because of the differences in the relative positions (or particle distribution) of the migration marking material in the $D_{max}$ and $D_{min}$ areas of the softenable layer, the $D_{max}$ and $D_{min}$ areas exhibit different photodischarge characteristics and optical absorption characteristics. Furthermore, the photodischarge characteristics can depend on the polarity of charging. For example, when a master with a hole transport material (capable of transporting positive charges) is charged negatively, the $D_{min}$ areas of the master may photodischarge almost completely while the $D_{max}$ areas may photodischarge very little. However, with positive charging, the $D_{max}$ areas of the same master may photodischarge almost completely while the $D_{min}$ areas photodischarge substantially less. Preferably, the potential difference between the migrated areas of the master and the unmigrated areas of the master is from about 50 to about 1200 volts, although this value can be outside of the specified range. Contrast potential efficiency is determined by dividing the potential difference between the migrated areas of the master and the unmigrated areas of the master by the initial voltage to which the master was charged prior to flood exposure and multiplying by 100 to obtain a percentage figure.

Subsequently, the electrostatic latent image formed by flood exposing the charged master to light is then developed with toner particles to form a toner image corresponding to the electrostatic latent image. For example, with negative charging, the electrostatic latent image is negatively charged and overlays the $D_{max}$ areas of the xeroprinting master. The toner particles carry a positive electrostatic charge and are attracted to the oppositely charged portions overlying the $D_{max}$ area (unmigrated particles). However, if desired, the toner can be deposited in the discharged areas by employing toner particles having the same polarity as the charged areas. The toner particles will then be repelled by the charges overlying the $D_{max}$ area and deposit in the discharged areas ($D_{min}$ area). Well known electrically biased development electrodes can also be employed, if desired, to direct toner particles to either the charged or discharged areas of the imaging surface.

The developing (toning) step is identical to that conventionally used in electrophotographic imaging. Any suitable conventional electrophotographic dry or liquid developer containing electrostatically attractable marking particles can be employed to develop the electrostatic latent image on the xeroprinting master. Typical dry toners have a particle size of from about 6 to about 20 microns. Typical liquid toners have a particle size of from about 0.1 to about 6 microns. The size of toner particles generally affects the resolution of prints. For applications demanding very high resolution, such as in color proofing and printing, liquid toners are generally preferred because their much smaller toner particle size gives better resolution of fine half-tone dots and produce four color images without undue thickness in densely toned areas. Conventional electrophotographic development techniques can be utilized to deposit the toner particles on the imaging surface of the xeroprinting master.

This invention is suitable for development with dry two-component developers. Two-component developers comprise toner particles and carrier particles. Typical toner particles can be of any composition suitable for development of electrostatic latent images, such as those comprising a resin and a colorant. Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they can be present in greater or lesser amounts, provided that the objectives of the invention are achieved.

Any suitable pigments or dyes or mixture thereof can be employed in the toner particles. Typical pigments or dyes include carbon black, nigrosine dye, aniline blue, magnetites, and mixtures thereof, with carbon black being a preferred colorant. The pigment is preferably present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles can be present provided that the objectives of the present invention are achieved.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the Color Index as Cl 60710, Cl Dispersed Red 15, a diazo dye identified in the Color Index as Cl 26050, Cl Solvent Red 19, and the like. Illustrative examples of suitable cyan pigments include copper tetra-4-(octadecyl sulfonamido) phthalocyanine, X-copper phthalocyanine pigment, listed in the Color Index as Cl 74160, Cl Pigment Blue, and Anthradanthrene Blue, identified in the Color Index as Cl 69810, Special Blue X-2137, and the like. Illustrative examples of yellow pigments that can be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. These color pigments are generally present in an amount of from about 15 weight percent to about 20.5 weight percent based on the weight of the toner resin particles, although lesser or greater amounts can be present provided that the objectives of the present invention are met.

When the pigment particles are magnetites, which comprise a mixture of iron oxides ($Fe_3O_4$) such as those commercially available as Mapico Black, these pigments are present in the toner composition in an amount of from about 10 percent by weight to about 70 percent by weight, and preferably in an amount of from about 20 percent by weight to about 50 percent by weight, although they can be present in greater or lesser amounts, provided that the objectives of the invention are achieved.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size between about 6 and about 20 microns.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a pigment, and an external additive can comprise 80 percent by weight of resin and 20 percent by weight of pigment; the amount of external additive present is reported in terms of its percent by weight of the combined resin and pigment. External additives can include any additives suitable for use in electrostatographic toners, including straight silica, colloidal silica (e.g. Aerosil R972®, available from Degussa, Inc.), ferric oxide, Unilin, polypropylene waxes, polymethylmethacrylate, zinc stearate, chromium oxide, aluminum oxide, stearic acid, polyvinylidene flouride (e.g. Kynar®, available from Pennwalt Chemicals Corporation), and the like. External additives can be present in any suitable amount, provided that the objectives of the present invention are achieved.

Any suitable carrier particles can be employed with the toner particles. Typical carrier particles include granular zircon, steel, nickel, iron ferrites, and the like.

Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process. Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. The toner may be present, for example, in the twocomponent developer in an amount equal to about 1 to about 5 percent by weight of the carrier, and preferably is equal to about 3 percent by weight of the carrier.

Typical dry toners are disclosed, for example, in U.S. Pat. No. 2,788,288, U.S. Pat. No. 3,079,342, and U.S. Pat. No. Reissue 25,136, the disclosures of each of which are totally incorporated herein by reference.

If desired, development can be effected with liquid developers. Liquid developers are disclosed, for example, in U.S. Pat. No. 2,890,174 and U.S. Pat. No. 2,899,335, the disclosures of each of which are totally incorporated herein by reference. Liquid developers can comprise aqueous based or oil based inks, and include both inks containing a water or oil soluble dye substance and pigmented inks. Typical dye substances are Methylene Blue, commercially available from Eastman Kodak Company, Brilliant Yellow, commercially available from the Harlaco Chemical Company, potassium permanganate, ferric chloride and Methylene Violet, Rose Bengal and Quinoline Yellow, the latter three available from Allied Chemical Company, and the like. Typical pigments are carbon black, graphite, lamp black, bone black, charcoal, titanium dioxide, white lead, zinc oxide, zinc sulfide, iron oxide, chromium oxide, lead chromate, zinc chromate, cadmium yellow, cadmium red, red lead, antimony dioxide, magnesium silicate, calcium carbonate, calcium silicate, phthalocyanines, benzidines, naphthols, toluidines, and the like. The liquid developer composition can comprise a finely divided opaque powder, a high resistance liquid, and an ingredient to prevent agglomeration. Typical high resistance liquids include such organic dielectric liquids as paraffinic hydrocarbons such as the Isopar® and Norpar® family, carbon tetrachloride, kerosene, benzene, trichloroethylene, and the like. Other liquid developer components or additives include vinyl resins, such as carboxy vinyl polymers, polyvinylpyrrolidones, methylvinylether maleic anhydride interpolymers, polyvinyl alcohols, cellulosics such as sodium carboxy-ethylcellulose, hydroxypropylmethyl cellulose, hydroxyethyl cellulose, methyl cellulose, cellulose derivatives such as esters and ethers thereof, alkali soluble proteins, casein, gelatin, and acrylate salts such as ammonium polyacrylate, sodium polyacrylate, and the like.

Any suitable conventional electrophotographic development technique can be utilized to deposit toner particles on the electrostatic latent image on the imaging surface of the xeroprinting master. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

The deposited toner image is subsequently transferred to a receiving member, such as paper, by, for example, applying an electrostatic charge to the rear surface of the receiving member by means of a charging means such as a corona device. If desired, the transferred toner image is thereafter fused to the receiving member by conventional means (not shown) such as an oven fuser, a hot roll fuser, a cold pressure fuser, or the like.

The deposited toner image can be transferred to a receiving member such as paper or transparency material by any suitable technique conventionally used in electrophotography, such as corona transfer, pressure transfer, abhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory transfer.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, abhesive spray fixing, and the like.

After the toned image is transferred, the xeroprinting master can be cleaned, if desired, to remove any residual toner and then erased by an AC corotron, or by any other suitable means. The developing, transfer, fusing, cleaning and erasure steps can be identical to that conventionally used in xerographic imaging. Since the xeroprinting master produces identical successive images in precisely the same areas, it has not been found necessary to erase the electrostatic latent image between successive images. However, if desired, the master can optionally be erased by conventional AC corona erasing techniques, which entail exposing the imaging surface to AC corona discharge to neutralize any residual charge on the master. Typical potentials applied to the corona wire of an AC corona erasing device range from about 3 kilovolts to about 10 kilovolts.

If desired, the imaging surface of the xeroprinting master can be cleaned. Any suitable cleaning step that is conventionally used in electrophotographic imaging can be employed for cleaning the xeroprinting master of this invention. Typical well known electrophotographic cleaning techniques include brush cleaning, blade cleaning, web cleaning, and the like.

After transfer of the deposited toner image from the master to a receiving member, the master can, with or without erase and cleaning steps, be cycled through additional uniform charging, uniform illumination, development and transfer steps to prepare additional imaged receiving members.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A migration imaging member was prepared by dissolving about 16.8 grams of a terpolymer of styrene/ethylacrylate/acrylic acid (62/36/2 by weight percent) and about 3.2 grams of N,N'-diphenyl-N,N'-bis(3''-methylphenyl)-(1,1'-biphenyl)-4,4'-diamine in about 80.0 grams of toluene. The terpolymer is a softenable material, and was prepared as described in U.S. Pat. No. 4,853,307, the disclosure of which is totally incorporated herein by reference, as set forth specifically in Example 20 (with the exception that the ratio of starting monomers was different in the instant Example, and corresponded to the desired ratio of 62 percent by weight styrene, 36 percent by weight ethyl acrylate, and 2 percent by weight acrylic acid). The N,N'-diphenyl-N,N'-bis(3''-methylphenyl)-(1,1'-biphenyl)-4,4'-diamine is a charge transport material capable of transporting positive charges (holes), and was prepared as described in U.S. Pat. No. 4,265,990, the disclosure of which is totally incorporated herein by reference. The styrene/ethylacrylate/acrylic acid terpolymer had the following properties: 62 mole percent styrene, 36 mole percent ethylacrylate, 2 mole percent acrylic acid, a $M_w$ of about 33,000, a $M_n$ of about 7,000, a glass transition temperature $T_g$ of about 50° C., and a melt viscosity of about $3.3\times10^4$ poise at 110° C. The resulting solution was coated by solvent extrusion techniques onto a 12 inch wide 100 micron (4 mil) thick Mylar® polyester film (available from E.I. Du Pont de Nemours & Company) having a thin, semi-transparent aluminum coating. The deposited softenable layer was allowed to dry at about 115° C. for about 2 minutes, and was then cooled to room temperature, resulting in a layer with a thickness of about 4 microns. The temperature of the softenable layer was then raised to about 115° C. to lower the viscosity of the exposed surface of the softenable layer to about $2\times10^4$ poises in preparation for the deposition of migration marking material. A thin layer of particulate vitreous selenium was then applied by vacuum deposition in a vacuum chamber maintained at a vacuum of about $4\times10^{-4}$ Torr. The imaging member was subsequently rapidly chilled to room temperature. A reddish monolayer of selenium particles having an average diameter of about 0.3 micron embedded about 0.05 to about 0.1 micron below the exposed surface of the copolymer was formed. The resulting imaging member had a very uniform optical density of about 1.85.

An electrostatic latent image was then formed on this imaging member by uniformly negatively charging the imaging member to a surface potential of about −400 volts with a corona charging device and subsequently exposing the member by placing a test pattern mask comprising a silver halide image in contact with the imaging member and exposing the member to light through the mask. The migration imaging member bearing the electrostatic latent image was then developed with a heat development apparatus as shown in FIG. 1. The imaging member passed through the apparatus at a rate of about 1 inch per second and was exposed to heat within the heat shield at the development temperature of 115° C. for the migration imaging member. Total heat development time for any portion of the imaging member, i.e. the time taken for the leading edge of imaging member to enter the development zone until the leading edge exited the development zone, was about 4 seconds. The pinch rollers were maintained at a temperature of 90° C. Subsequent to passing through the development apparatus, the migration imaging member exhibited a developed image corresponding to the latent image, wherein the image was formed by migration of the migration marking particles through the softenable material in imagewise pattern. The developed migration imaging member exhibited no image defects such as spotty film pick-off (pin holes) or large area film delamination which might otherwise have been caused by offset (sticking or adhesion) of the member surface of imaging member onto the pinch rollers, and which would be expected if the temperature of the pinch rollers had been maintained at the development temperature of 115° C. or at a temperature of less than 20° C. lower than this temperature. The developed migration imaging member exhibited a uniformly developed visible image with a $D_{min}$ of 0.72 and a $D_{max}$ of 1.85.

EXAMPLE II

The developed migration imaging member of Example I was then used as a xeroprinting master in a xeroprinting process. The xeroprinting master was incorporated into a Xeroprinter® 100 machine available from Fuji Xerox Company, Ltd. by replacing the orginal zinc oxide photoreceptor in the machine with the imaging member prepared as described in Example I. In addition, the incandescent flood exposure lamp in the machine was replaced with an 8 watt green fluorescent photoreceptor erase lamp (available from Fuji Xerox Company, Ltd. as #122P60205) as the flood exposure light source. The master was uniformly negatively charged to a potential of about −400 volts and then flood exposed to form an electrostatic latent image on the master surface. Subsequently, the latent image was developed with the black dry toner supplied with the Xeroprinter® 100 machine and the developed image was transferred and fused to Xerox® 4024 plain paper (11''×17'' size) to yield a very high quality xeroprint.

COMPARATIVE EXAMPLE A

A similar migration imaging member was prepared and imaged by the same process as described in Example I, but was developed by a heat development apparatus wherein the pinch rollers were maintained at the development temperature of 115° C. for the imaging member. Specifically, the heat development apparatus employed was similar to the one depicted in FIG. 1 except that conveyance rollers 15 and 17 and pinch rollers 19 and 21 were situated within heat shield 5. The developed migration imaging member exhibited image defects, including spotty film pick-off (pin holes) and large area film delamination caused by offset (sticking or adhesion) of the film surface of imaging member onto the pinch rollers.

EXAMPLE III

A migration imaging member was prepared by dissolving about 16.8 grams of a commercial terpolymer of styrene/ethylacrylate/acrylic acid (available from DeSoto Inc. under the trade name of E-335), and about 3.2 grams of N,N'-diphenyl-N,N'-bis(3''-methylphenyl)-(1,1'-biphenyl)-4,4'-diamine in about 80.0 grams of toluene. The N,N'-diphenyl-N,N'-bis(3''-methylphenyl)-(1,1'-biphenyl) -4,4'-diamine is a charge transport material capable of transporting positive charges (holes), and was prepared by the process described in U.S. Pat. No. 4,265,990, the disclosure of which is totally incorporated herein by reference. The commercial styrene/ethylacrylate/acrylic acid terpolymer had the following properties: 48 mole percent of styrene, 50 mole percent of ethylacrylate, 2 mole percent of acrylic acid, a $M_w$ of about 54,000, a $M_n$ of about 21,000, a glass transition temperature $T_g$ of about 36° C., and a melt viscosity of about $3.0\times10^4$ poise at 110° C. The resulting solution was coated by solvent extrusion techniques onto a 12 inch wide 100 micron (4 mil) thick Mylar® polyester film (available from E.I. Du Pont de Nemours & Company) having a thin, semi-transparent aluminum coating. The deposited softenable layer was allowed to dry at about 115° C. for about 2 minutes, and was then cooled to room temperature, resulting in a dried softenable layer with a thickness of about 4 microns. The temperature of the softenable layer was then raised to about 115° C. to lower the viscosity of the exposed surface of the softenable layer to about $2\times10^4$ poises in preparation for the deposition of marking material. A thin layer of particulate vitreous selenium was subsequently applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to about 0.1 micron below the exposed surface of the copolymer was formed. The resulting imaging member had a very uniform optical density of about 1.85.

An electrostatic latent image was formed on this imaging member by uniformly negatively charging the imaging member to a surface potential of about −400 volts with a corona charging device, and the member was subsequently exposed by placing a test pattern mask comprising a silver halide image in contact with the imaging member and exposing the member to light through the mask. The migration imaging member bearing the electrostatic latent image was then developed with a heat development apparatus as shown in FIG. 1. The imaging member passed through the apparatus at a rate of about 1 inch per second and was exposed to heat within the heat shield at the development temperature of 115° C. for the migration imaging member. Total heat development time for any portion of the imaging member, i.e. the time taken for the leading edge of imaging member to enter the development zone until the leading edge exited the development zone, was about 4 seconds. The pinch rollers were maintained at a temperature of 90° C.. Subsequent to passing through the development apparatus, the migration imaging member exhibited a developed image corresponding to the latent image, wherein the image was formed by migration of the migration marking particles through the softenable material in imagewise pattern. The developed migration imaging member exhibited no image defects such as spotty film pick-off (pin holes) or large area film delamination which would otherwise have been caused by offset (sticking or adhesion) of the surface of imaging member onto the pinch rollers, and which would be expected if the temperature of the pinch rollers had been maintained at the development temperature of 115° C. or at a temperature of less than 20° C. lower than this temperature. The developed migration imaging member exhibited a uniformly developed visible image with a $D_{min}$ of 0.71 and a $D_{max}$ of 1.85.

EXAMPLE IV

The developed migration imaging member of Example III was then used as a xeroprinting master in a xeroprinting process. The xeroprinting master was incorporated into a Xeroprinter® 100 machine available from Fuji Xerox Company, Ltd. by replacing the orginal zinc oxide photoreceptor in the machine with the imaging member prepared in Example III. In addition, the incandescent flood exposure lamp in the machine was replaced with an 8 watt green fluorescent photoreceptor erase lamp (available from Fuji Xerox Company, Ltd. as #122P60205) as the flood exposure light source. The master was uniformly negatively charged to a potential of about −400 volts and then flood exposed to form an electrostatic latent image on the master surface. Subsequently, the latent image was developed with the black dry toner supplied with the Xeroprinter® 100 machine and the developed image was transferred and fused to Xerox® 4024 plain paper (11''×17'' size) to yield a very high quality xeroprint.

COMPARATIVE EXAMPLE B

A migration imaging member was prepared and imaged by the process as described in Example III, but was developed by a heat development apparatus wherein the pinch rollers were maintained at the development temperature of about 115° C. for the imaging member. Specifically, this apparatus was similar to the one depicted in FIG. 1 except that pinch rollers 19 and 21 were situated within heat shield 5. The developed migration imaging member exhibited image defects, including spotty film pick-off (pin holes) and large area film delamination caused by offset (sticking or adhesion) of the surface of the imaging member onto the pinch rollers.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging process which comprises (1) providing a migration imaging member comprising (a) a substrate and (b) a softenable layer comprising a softenable material, optional charge transport material, and migration marking material situated contiguous to the surface of the softenable layer spaced from the substrate; (2) uniformly charging the imaging member; (3) exposing the charged imaging member to activating radiation in an imagewise pattern, thereby forming an electrostatic latent image on the imaging member; and (4) developing the imaging member with a heat development apparatus which comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development, thereby causing migration marking material to migrate through the softenable material toward the substrate in imagewise fashion.

2. An imaging process according to claim 1 wherein the heat development apparatus also contains a heat shield situated so as to inhibit the escape of heat from the heating source during exposure of the imaging member to heat, wherein the first pinch roller and the second pinch roller are situated outside of the heat shield.

3. An imaging process according to claim 1 wherein the surface temperature of the first and second pinch rollers in the heat development apparatus is maintained at a temperature at least 20° C. below the development temperature of the migration imaging member by a cooling means which removes heat from the pinch roller surfaces.

4. An imaging process according to claim 1, 2 or 3 wherein the first pinch roller and the second pinch roller in the heat development apparatus each have an abhesive surface of a material selected from the group consisting of fluoropolymers and silicone polymers.

5. An imaging process according to claim 1, 2, or 3 wherein the first pinch roller and the second pinch roller in the heat development apparatus each have an abhesive surface of a material selected from the group consisting of poly(tetrafluoroethylene), poly(trifluoromethyltrifluoroethylene-co-tetrafluoroethylene), poly(heptafluoropropylethylene), poly(heptafluoropropylethylene-cotetrafluoroethylene), and poly(trifluoromethyltrifluoroethylene).

6. A xeroprinting process which comprises (1) providing a migration imaging member comprising (a) a substrate and (b) a softenable layer comprising a softenable material, a charge transport material, and migration marking material situated contiguous to the surface of the softenable layer spaced from the substrate; (2) uniformly charging the imaging member; (3) exposing the charged imaging member to activating radiation in an imagewise pattern, thereby forming an electrostatic latent image on the imaging member; (4) developing the imaging member with a heat development apparatus which comprises a heating source, a conveyance means for conveying the migration imaging member past the heating source, a first pinch roller in contact with the conveyance means, and a second pinch roller in contact with the conveyance means, wherein the imaging member passes through a nip between the conveyance means and the first pinch roller subsequent to entering the apparatus and prior to exposure to the heating source and passes through a nip between the conveyance means and the second pinch roller subsequent to exposure to the heating source and prior to exiting the apparatus, wherein the surface temperature of the first pinch roller is maintained at a temperature at least 20° C. below the development temperature of the migration imaging member during the period in which the first pinch roller contacts the migration imaging member, wherein the surface temperature of the second pinch roller is maintained at a temperature at least 20° C. below the development temperature of the migration imaging member during the period in which the second pinch roller contacts the migration imaging member, and wherein the heating source is maintained at the development temperature of the migration imaging member during development, thereby causing migration marking material to migrate through the softenable material toward the substrate in imagewise fashion to result in a xeroprinting master; (5) uniformly charging the xeroprinting master; (6) uniformly exposing the charged master to activating radiation to result in an electrostatic latent image corresponding to the migration image; (7) developing the electrostatic latent image with a toner; and (8) transferring the developed image to a receiver sheet.

7. An imaging process according to claim 6 wherein the heat development apparatus also contains a heat shield situated so as to inhibit the escape of heat from the heating source during exposure of the imaging member to heat, wherein the first pinch roller and the second pinch roller are situated outside of the heat shield.

8. An imaging process according to claim 6 wherein the surface temperature of the first and second pinch rollers in the heat development apparatus is maintained at a temperature at least 20° C. below the development temperature of the migration imaging member by a cooling means which removes heat from the pinch roller surfaces.

9. An imaging process according to claim 6, 7, or 8 wherein the first pinch roller and the second pinch roller in the heat development apparatus each have an abhesive surface of a material selected from the group consisting of fluoropolymers and silicone polymers.

10. An imaging process according to claim 6, 7, or 8 wherein the first pinch roller and the second pinch roller in the heat development apparatus each have an abhesive surface of a material selected from the group consisting of poly(tetrafluoroethylene), poly(trifluoromethyltrifluoroethylene-co-tetrafluoroethylene), poly(heptafluoropropylethylene), poly(heptafluoropropylethylene-cotetrafluoroethylene), and poly(trifluoromethyltrifluoroethylene).

* * * * *